United States Patent [19]

Funaki

[11] 4,432,181

[45] Feb. 21, 1984

[54] WALL CONSTRUCTION FOR ARCHITECTURAL STRUCTURE

[76] Inventor: Motokatsu Funaki, 430 Shimo-Tsuchidana, Fujisawa-shi, Kanagawa-ken, Japan

[21] Appl. No.: 375,253

[22] Filed: May 5, 1982

[30] Foreign Application Priority Data

| | | | |
|---|---|---|---|
| Aug. 13, 1981 | [JP] | Japan | 56-119347 |
| Sep. 30, 1981 | [JP] | Japan | 56-144186 |
| Sep. 30, 1981 | [JP] | Japan | 56-153786 |
| Nov. 11, 1981 | [JP] | Japan | 56-167130 |

[51] Int. Cl.[3] ..... E04F 13/08; E04B 1/54

[52] U.S. Cl. ..... 52/459; 52/519; 52/531; 52/478

[58] Field of Search ..... 52/459–471, 52/519–522, 529–535, 404, 551, 633, 478–485, 489

[56] References Cited

U.S. PATENT DOCUMENTS

| | | | |
|---|---|---|---|
| 407,772 | 7/1889 | Curtis et al. | 52/520 |
| 1,089,555 | 3/1914 | Hawksworth | 52/461 |
| 1,830,656 | 11/1931 | Herbest | 52/220 |
| 2,366,149 | 12/1944 | Robertson et al. | 52/478 |
| 2,820,535 | 1/1958 | Hutchison | 52/545 |
| 3,157,003 | 11/1964 | Domar | 52/531 |
| 3,253,376 | 5/1966 | Straus | 52/520 |
| 3,295,283 | 1/1967 | Griffith et al. | 52/461 |
| 3,324,617 | 6/1967 | Knight et al. | 52/521 |
| 3,968,603 | 7/1976 | Merson | 52/630 |

FOREIGN PATENT DOCUMENTS

| | | | |
|---|---|---|---|
| 517195 | 2/1953 | Belgium | 52/489 |
| 482256 | 4/1952 | Canada | 52/522 |
| 2603209 | 8/1977 | Fed. Rep. of Germany | 52/551 |
| 744516 | 1/1933 | France | 52/479 |
| 790539 | 9/1935 | France | 52/404 |
| 1200741 | 7/1959 | France | 52/633 |
| 53-161515 | 12/1978 | Japan . | |
| 54-77517 | 6/1979 | Japan . | |
| 55-44832 | 11/1980 | Japan . | |

*Primary Examiner*—James L. Ridgill, Jr.

*Attorney, Agent, or Firm*—Blum, Kaplan, Friedman, Silberman and Beran

[57] ABSTRACT

A wall construction for use as an outer wall, a roof or the like in an architectural structure is disclosed which is capable of effectively accomplishing sound absorption and insulation and heat insulation. The wall construction includes a first coat member of sound absorbing and heat insulating properties disposed on a base member and a sheathing member of sound and heat insulating properties spaced through a support member from the first coat member to define a space therebetween.

7 Claims, 19 Drawing Figures

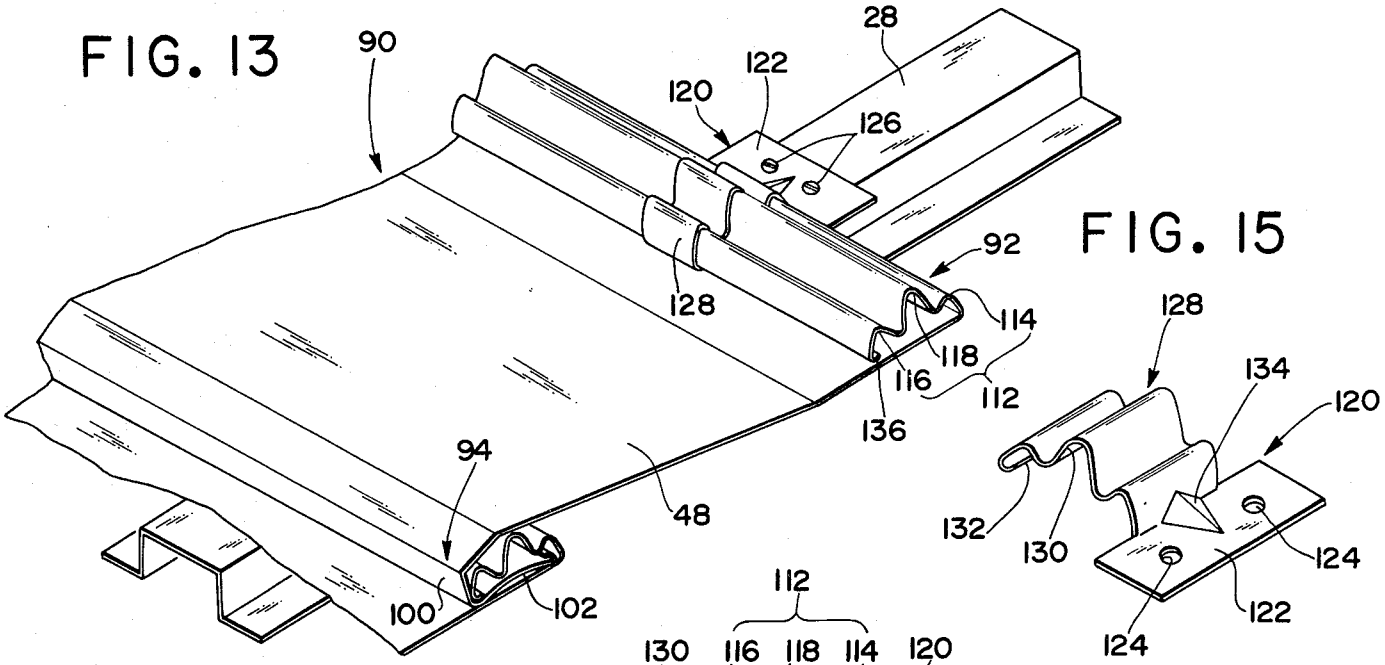
FIG. 13
FIG. 15
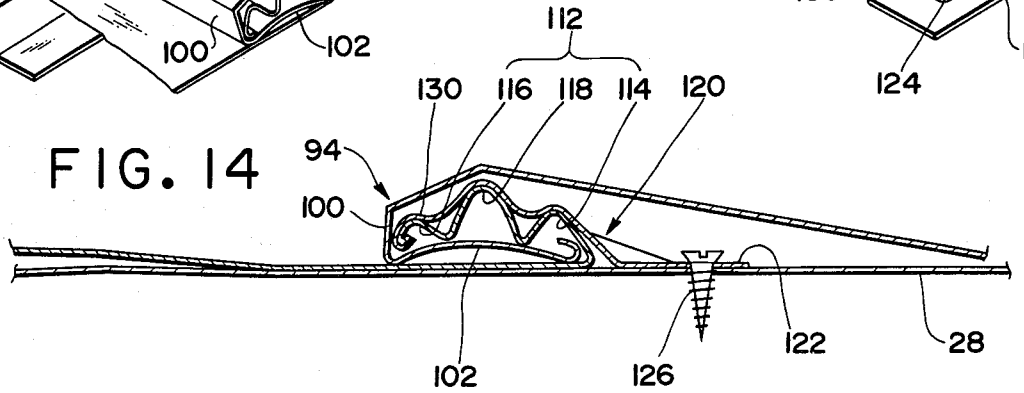
FIG. 14

WALL CONSTRUCTION FOR ARCHITECTURAL STRUCTURE

BACKGROUND OF THE INVENTION

This invention relates to a wall construction for an architectural structure, and more particularly, to a wall construction which is adapted to be used as an outer wall, a roof and the like in an architectural structure such as a building, a house, a gymnasium or the like.

A conventional wall construction such as an outer wall and a roof in a building, a house or the like comprises base members, elongated supporting members mounted on the base members so as to be spaced from one another at predetermined intervals in the lateral direction, sheathing boards securely laid through the supporting members on the base members, waterproof sheet members disposed to cover over the sheathing boards and face members mounted on the sheet members. Such conventional wall construction has a disadvantage that it is substantially impossible to accomplish good sound insulation because beating of raindrops and outdoor noise directly reach the interior of the building. The conventional wall construction also is not adapted to allow good heat insulation to be accomplished.

In a house, interior electrical wiring is often stretched around places in sight, such as the under surface of the ceiling and places out of sight such as base members of a wall construction by means of insulators. Therefore, the interior wiring is not effectively protected at a fire so as to significantly extend the time of electrical current conduction through the wiring, and thereby facilitate rescue operations.

In the conventional wall construction, supporting members or common rafters are generally fixed on base members or purlins by a screw or bolt means or metal band means. However, the fixing method by screw or bolt means causes the head portion of the screw or bolt to contact with or deform a face member, resulting in the face member being damaged. Such disadvantage is increased when the face member is formed of a metal plate such as aluminum. A similar disadvantage is encountered when fixing with metal strip means.

In addition, in the conventional wall construction, face members disposed adjacent to each other in the vertical direction are connected to each other through pawls formed on supporting members by raising a part of the supporting members. However, such a connecting method has a disadvantage in that, when a violent wind blows into the connecting portion, the face members are turned up to cause the connecting portion to be easily disengaged. In addition, in such connecting, the pawl has exposed surfaces and sharp cut edges, resulting in the supporting member and face member being subjected to corrosion and damage, respectively. Also, such a connecting method has a further disadvantage that rainwater enters the interior of the wall construction because the adjacent face members contact each other at the connecting region, formed with a gap sufficient to produce a capillary action.

Furthermore, the prior art wall construction is constructed in such a manner that face members disposed adjacent to each other in the lateral direction are connected to each other by merely inserting the end portions of the face members into connecting means. Therefore, such a connecting method is not adapted to efficiently prevent rainwater from entering the interior of the wall construction. The connecting means comprises a connecting member and a holding member fitted on the connecting member. However, the manufacture of the holding member is highly costly because it requires a complicated bending process.

SUMMARY OF THE INVENTION

The present invention has been made in view of the foregoing disadvantages in the prior art.

In accordance with the present invention, there is provided a wall construction for an architectural structure comprising base means, first coat means laid on the base means, a plurality of elongated supporting members each formed of a metal sheet by bending and disposed on the first coat means in the vertical direction of the wall construction so as to be spaced from each other at a predetermined interval in the lateral direction of the wall construction, a plurality of sheathing members each fixedly supported at both ends thereof on the adjacent supporting members to cover the first coat means and define a space between the sheathing members and the first coat means, and face means laid on the sheathing members.

Accordingly, it is an object of the present invention to provide an improved wall construction suitable for use as an outer wall and a roof in an architectural structure which is capable of effectively absorbing and insulating indoor and outdoor noise and accomplishing an improved heat insulation.

It is another object of the present invention to provide an improved wall construction which is capable of allowing interior electrical wiring to be safely stretched around the outermost portions of the wall constuction to ensure protection of the wiring at a fire so as to significantly extend the time when electrical current can flow therethrough, thereby facilitating rescue operations, as well as accomplishing improved heat insulation and sound insulation.

It is another object of the present invention to provide an improved wall construction which is adapted to not only accomplish improved heat and sound insulation but also to receive, in a supporting member, fixing means for securing the supporting member on a base member so that the fixing means may be prevented from projecting from the supporting member.

It is a further object of the present invention to provide an improved wall construction in which face members disposed adjacent to one another in the vertical direction are securely connected to each other so as to weather a violent wind.

It is a further object of the present invention to provide an improved wall construction in which face members disposed adjacent to each other in the lateral direction are securely connected to each other by simple means so as to effectively prevent rainwater from entering the interior of the wall construction.

It is a further object of the present invention to provide a supporting member for an improved wall construction suitable for use as an outer wall and a roof in an architectural structure which is capable of providing the wall construction with improved sound and heat insulation.

It is a further object of the present invention to provide a supporting member for an improved wall construction which is capable of allowing interior wiring to be safely stretched around the outermost portions of the wall construction, as well as allowing the weight of the wall construction to be significantly reduced.

It is a further object of the present invention to provide a supporting member for an improved wall construction which is capable of receiving therein fixing means for fixing the supporting member on a base member, to thereby prevent the fixing means from injuring face members.

It is still a further object of the present invention to provide means for fixedly connecting adjacent face members disposed in the vertical direction to each other so as to weather a violent wind and prevent rainwater from entering the interior of the wall construction.

It is an even further object of the present invention to provide connecting means for securely connecting adjacent face members disposed in the lateral direction to each other so as to prevent rainwater from entering the interior of an improved wall construction and to weather violent wind.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which like reference numerals designate the same or similar parts throughout the figures and wherein:

FIG. 13 is an enlarged, partial, perspective view showing an essential part of another face means;

FIG. 14 is a sectional view showing the connecting portion of the face means shown in FIG. 13;

FIG. 15 is a perspective view showing a fixing member used in the face means of FIG. 13;

DESCRIPTION OF THE PREFERRED EMBODIMENTS

Figure 1:
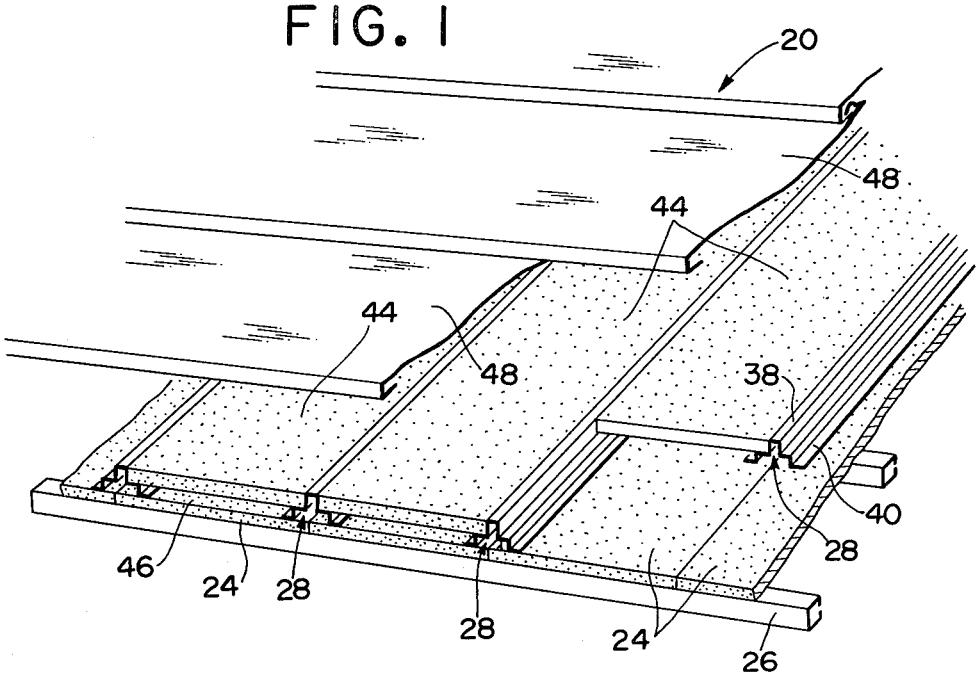
FIG. 1 is a partially exploded fragmentary perspective view of a wall construction in accordance with the present invention.
Figure 2:
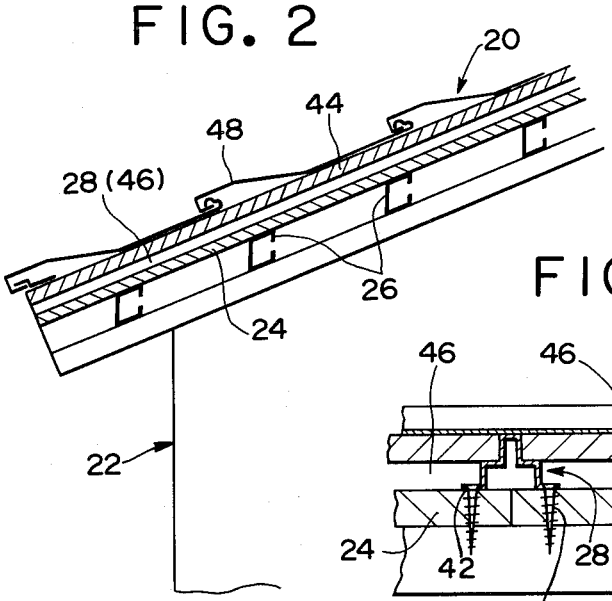
FIG. 2 is a partial longitudinal sectional view of the wall construction shown in FIG. 1.
Figure 3:
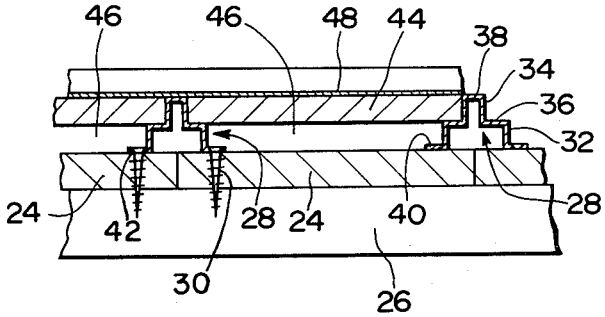
FIG. 3 is an enlarged, partial, sectional view of the wall construction shown in FIG. 1.

Referring now to FIGS. 1 to 3 illustrating one embodiment of a wall construction according to the present invention, the wall construction is generally designated by reference numeral 20. In the illustrated embodiment, The wall construction is in the form of a roof construction which is adapted to be applied to a building 22 such as a wooden building, a mortared frame building, a gymnasium or the like. The roof construction 20 includes a plurality of first coat members 24 mounted adjacent to one another on base members or purlins 26 provided at the upper portion of the building. The purlins 26 are disposed parallel to one another in the direction perpendicular to the slanting direction of the roof 20, with predetermined intervals being defined between the adjacent ones in the horizontal and vertical directions. Each of the first coat members 24 is disposed on the purlins 26 so as to extend in the slanting direction of the roof 20 in close proximity to the adjacent ones and securely fixed on the purlins 26 by a suitable fixing means such as bolts, screws or nails. Each of the first coat members 24 preferably comprises a soft excelsior board having sound absorbing and heat insulating properties.

The roof construction 20 also includes a plurality of longitudinally extending supporting members or common rafters 28 spaced from one another, with a predetermined interval being defined between the adjacent ones, and securely fixed on the first coat members 24 by means of bolts 30. The supporting members 28 are disposed to extend from a ridge to front eaves in the slanting direction of the roof 20. The supporting members are preferably formed of a metal plate into a substantially convex shape in section. More particularly, each of the members 28, as shown in FIG. 3, formed to have a pair of longitudinally extending lower side portions 32 of a predetermined height spaced from each other, a pair of longitudinally extending upper side portions 34 of a predetermined height spaced from each other at a smaller distance, a pair of longitudinally extending flat step portions 36 through which the upper side portions 34 are connected to the lower side portions 32, and a flat top portion 38 extending between the upper side portions 34. Each of the supporting members 28 is formed at the lower ends thereof with flanges 40 outwardly extending therefrom. The flanges are preferably provided along the entire longitudinal direction of the member 28. The flanges 40 are provided with a plurality of openings 42 along the longitudinal direction through which the bolts 30 are inserted into the purlins 26 to fix the supporting members 28 with respect to the purlins 26 and the first coat member 24.

The roof construction 20 further includes a plurality of sheathing boards 44 supported between the opposite step portions 36 of the adjacent supporting members. The sheathing board 44 is preferably formed of a relatively hard material having sound insulating and heat insulating properties, such as a cemented pulp board or the like. Each of the sheathing boards 44 is securely mounted at the both end portions thereof on the opposite step portions 36 of the adjacent supporting members 28, this resulting in a space 46 being formed between the first coat members 24 and the sheathing boards 44 which has a distance corresponding to the height of the lower side portions 32 of the supporting members 28. The fixing of the sheathing boards 42 onto the supporting members may be accomplished by clamping the end portions of the sheathing boards with respect to the step portions 36 of the members by means of clamping bolts or screws. Alternatively, it may be accomplished by engainging the sheathing boards with pawls formed on the step portions 36. The sheathing boards 44 are preferably formed so as to have a thickness corresponding to the height of the upper side portions 34.

The space 46 between the first coat members 24 and the sheathing boards 44 is adapted to receive therein an ambient atmosphere acting as a heat insulating air barrier, so that the roof construction 20 may more significantly improve a heat insulating effect. The space 46 may be filled with a heat insulating and sound absorbing material such as glass wool to provide the roof construction with a further improved sound absorbing effect as well as a better heat insulating effect.

The roof construction 20 further includes face members or roofing members 48 mounted on the sheathing boards 44. The roofing members 48 are disposed in a manner that each of the members 48 overlaps at the lower end portion thereof with the upper end portion of the downward adjacent one. The roofing members 48 are fixed through the sheathing boards 44 on the top portions 38 of the supporting members 28 by a suitable means such as screws, bolts or the like. The fixing of the roofing members may be accomplished at the overlapping portions thereof.

Thus, it will be noted that the roof construction illustrated in FIGS. 1 to 3, as described above, is constructed so that indoor sound generated from a piano, a record player or the like may be effectively absorbed by the first coat members 24 to be prevented from leaking to the outdoors and outdoor noise may be effectively absorbed by the sheathing boards 44 to be prevented for reaching the interior of a building. In addition, an improved heat insulating effect is significantly accomplished by the combination of the first coat members and sheathing members with the space 46. Furthermore, the roof construction illustrated in FIGS. 1 to 3 has advantages such as easy construction operation, short construction time and the like. It should be noted that the illustrated embodiment is of course applied to an outer wall of a building and a ceiling of each story of a building.

Figure 4:
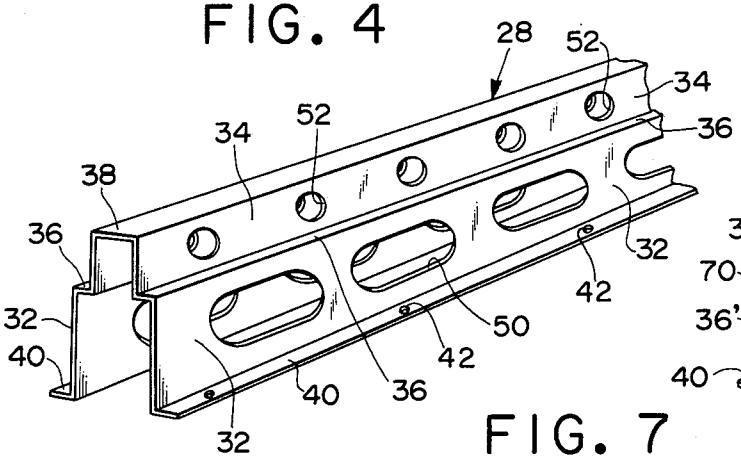
FIG. 4 is a partial perspective view showing a modification of a supporting member used in the wall construction of FIG. 1.

FIG. 4 illustrates a modification of the supporting member 28, which is adapted to be capable of not only allowing the wall construction of the invention to effectively accomplish sound absorbing and insulating effects and a heat insulating effect but allowing interior wiring to be safely stretched around the outermost portions of the wall construction to ensure significant protection of wiring at a fire to extend conduction time of electrical current therethrough as long as possible, thereby facilitating rescue operation. In addition, it is adapted to be capable of significantly lightening the entire weight of the wall construction.

The supporting member 28 shown in FIG. 4 is formed of a metal sheet to have each pair of longitudinally extending lower side portions 32, upper side portions 34 and flat step portions 36, and a flat top portion 38 which are respectively in the substantially same manner as those of the supporting member shown in FIGS. 1 to 3.

The lower side portions 32 of the supporting member respectively have a plurality of through-holes 50 formed in a relationship spaced from each other in the longitudinal direction thereof in such a manner that each of the through-holes 50 of one lower side portion 32 aligns with the corresponding one 50 of the other lower side portion 32 in the lateral direction. Each of the through-holes is preferably formed in a large oval shape to permit interior wiring to pass therethrough and allow the supporting member to be lightened. It is desired to fit an insulating member onto each through-hole 50 to ensure the electrical insulation between the supporting member 28 and interior wiring. The upper side portions 34 of the supporting member 28 respectively have a plurality of openings 52 disposed along the longitudinal direction thereof to permit the weight of the supporting member to be lightened.

Figure 5:
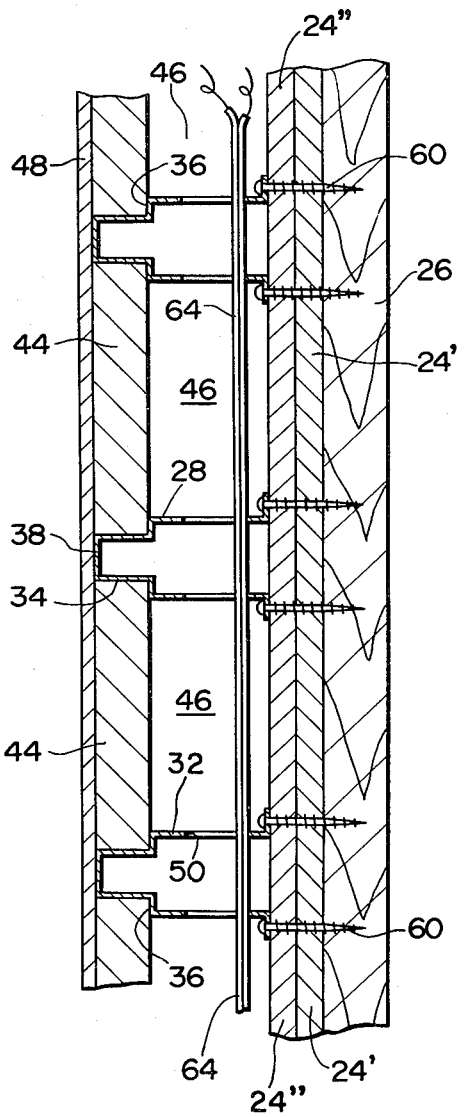
FIG. 5 is an enlarged sectional view showing the use of the supporting member shown in FIG. 4.

The manner of use of the supporting member 24 of FIG. 4 in the wall construction is illustrated in FIG. 5, in which the wall construction is in the form of an outer wall construction of a building. The supporting members 24 are fixed onto base members 26 of the wall construction through a first coat member 24' of a sound absorbing material and a second coat member 24" of a fire-proofing material by suitable fixing means 60 such as screws, bolts or the like. The supporting members are disposed in such a manner that the corresponding through-holes 50 of the supporting members are aligned with one another in the lateral direction. The supporting members securely support ends of each sheathing board 44 of a sound insulating material on the step portions 36 by a suitable fixing means to space the boards 44 from the second coat member 24" to thereby form a space 46 acting as a heat insulating air barrier between the boards 44 and 24". Interior wiring 64 vertically extends within the space 46 through the through-holes 50 of the supporting members which support the wiring 64 in a relationship spaced from the boards 44 and 24". Thus, it will be noted that the supporting member effectively accomplished the above-mentioned advantages. The sheathing board 44 is preferably formed to have a thickness corresponding to the height of the upper side portions 34 of the supporting member. The boards 44 have face members 48 disposed thereon which are fixed on the top portions 38 of the supporting members by a suitable fixing means. The interior wiring 64 may be disposed to extend through the openings 52 of the upper side portions 34, as desired. In such case, it is of course, necessary that the step portions 36 are not used to support the boards 62. And, the openings 52 are preferably provided so that each of the openings of one upper side portion aligns with the corresponding one of the other upper side portion.

Figure 6:
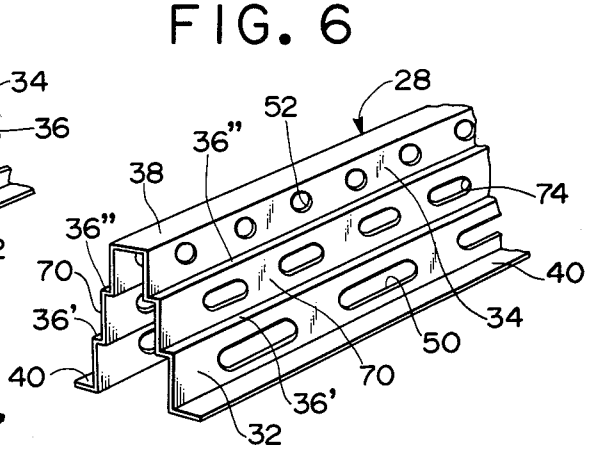
FIG. 6 is a partial perspective view showing another modification of a supporting member used in the embodiment of FIG. 1.

Another modification of the supporting member is illustrated in FIG. 6, which is constructed to have lower side portions 32, upper side portions 34, a flat top portion 38 and flanges 40 which are respectively formed in the substantially same manner as those of the supporting member of FIG. 4, as well as at least one pair of intermediate side portions 70 extending between the lower and upper side portions 32 and 34 in the longitudinal direction; the intermediate side portions being connected to the adjacent side portions 32 and 34 through flat step portions 36' and 36", respectively.

The upper side portions 34 of the supporting member are provided with openings 52 to allow the weight of the supporting member to be lightened. The intermediate side portions 70 and the lower side portions 32 respectively have through-holes 74 of an oval shape and through-holes 50 of a larger oval shape formed along the longitudinal direction in the substantially same manner as the holes 50 of the supporting member of FIG. 4 which are sufficient to allow interior wiring to pass therethrough and permit the supporting member to be lightened. Interior wiring may be stretched through both of through-holes 74 and 50 or either one.

Figure 7:
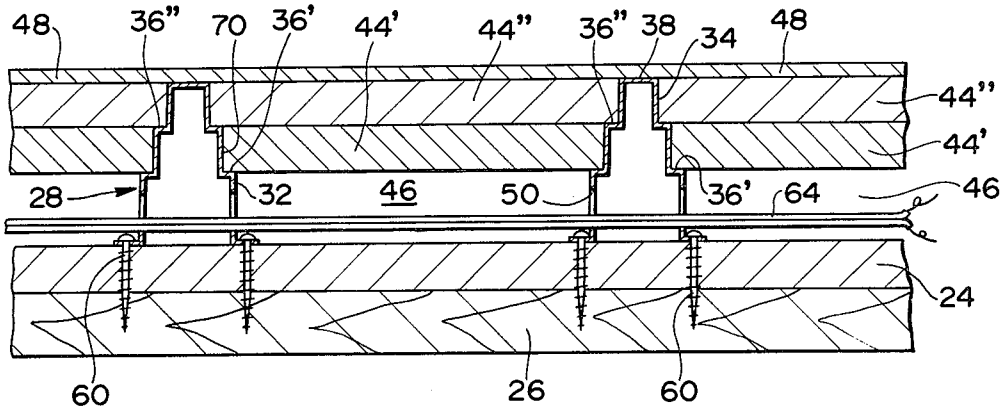
FIG. 7 is an enlarged sectional view showing the use of the supporting member shown in FIG. 6.

The manner of use of the supporting member of FIG. 6 is shown in FIG. 7. In FIG. 7, the wall construction is in the form of a roof construction. The supporting members 28 are fixed onto purlins or base members 26 through a first coat member 24 of a fire proofing material by a fixing means 60 in the substantially same manner as in FIG. 5. The supporting members support ends of first sheathing boards 44' on the step portions 36' so as to space the boards 44' from the member 24, to thereby define a space 46 acting as a heat insulating air barrier therebetween. The supporting members also support on the step portions 36" ends of second sheathing boards 44" of a sound insulating material in close proximity to the boards 44'. The boards 44' and 44" are preferably formed to have thicknesses corresponding to the heights of the intermediate and upper side portions 70 and 34, respectively. An interior wiring 64 is disposed to extend within the space 46 through the through-holes 50 of the lower side portions 32. However, it may be disposed to extend through the through-holes 74 of the intermediate side portions 70, as desired; and , in such case, the space 46 is defined between the step portions 36" and the first coat member 24, pipings for tap water and town gas may be disposed to extend through the through-holes 50.

It should be understood that the wall construction of FIG. 7 may be applied to an outer wall construction of a building, a ceiling construction of each story of a building and the like.

In the wall constructions illustrated in FIGS. 5 and 7, heat insulating boards, fire-proofing boards, sound absorbing boards and sound insulating boards may be combined as desired in view of the purpose of insulating noise, insulating heat or the like.

Figure 8:
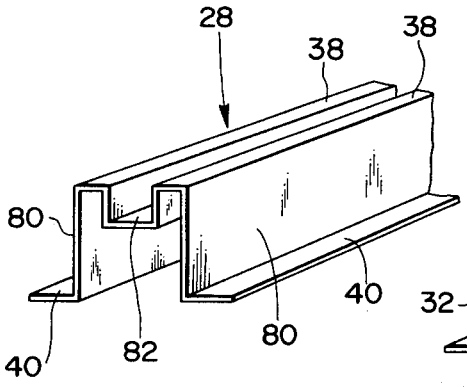
FIG. 8 is a partial perspective view showing a further modification of a supporting member used in the embodiment of FIG. 1.

FIG. 8 illustrates a further modification of the supporting member, which is adapted to be capable of not only providing a wall construction with heat insulating and sound insulating effects but also receiving therein the head portion of a fixing means for securing the supporting members with respect to base members of the wall so that the fixing means may be prevented from projecting from the supporting member to contact with and/or injure face members and the like. It is also adapted to be fixed with respect to the base members only by screws or bolts.

Figure 10:
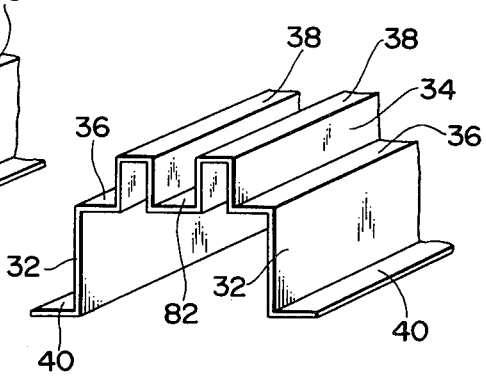
FIGS. 9 and 10 are partial perspective views showing modifications of the supporting member of FIG. 8.
Figure 9:
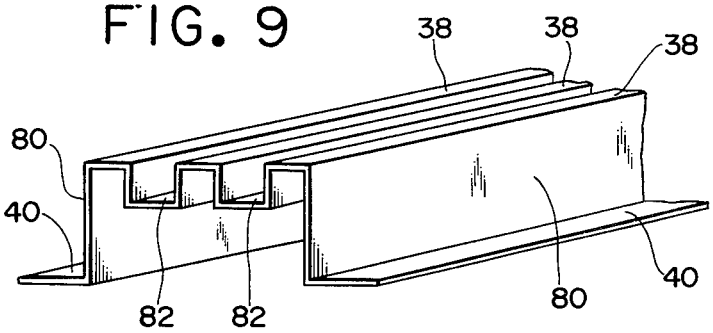

The supporting member 28 of FIG. 8 is formed of a metal sheet to have a pair of longitudinaly extending side portions 80 having a predetermined height and each having a flange 40 outwardly projecting therefrom and extending along the longitudinal direction, a pair of longitudinally extending flat top portions 38 flush with each other, and a groove 82 formed between the top portions. The groove 82 is formed to have a depth and a width sufficient to receive therein the head portion of a fixing means such as bolts or screws for fixing the supporting member onto base members of a wall. The groove 82 may be formed to have a bottom portion flush with the flanges 40. The supporting member may be provided with two or more grooves 82, as shown in FIG. 9. In addition, each of the side portions 80, as shown in FIG. 10, may be divided into a lower side portion 32 and an upper side portion 34 connected to each other through a step portion 36.

Figure 11:
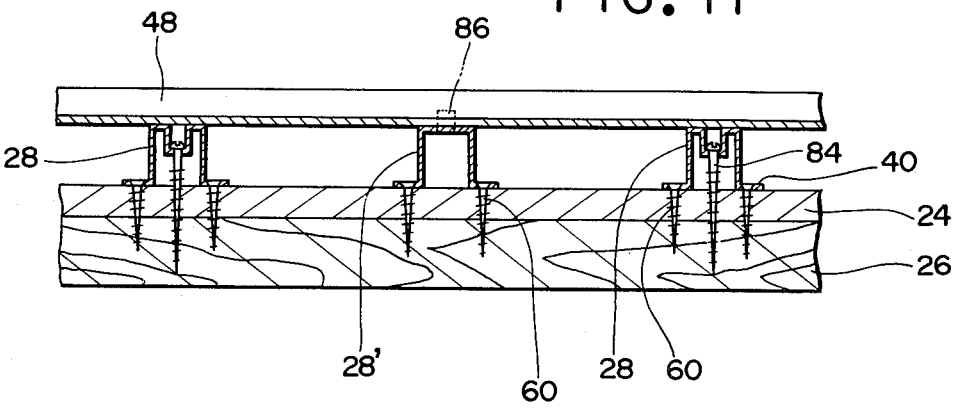
FIG. 11 ia an enlarged sectional view showing the use of the supporting member shown in FIG. 8.

The supporting member 28 of FIG. 8 is used in a manner as shown in FIG. 11. The supporting members are fixed with respect to base members 26 of a wall construction 20 through a first coat member 24 by means of screws 84 which are received at the head portions thereof in the grooves 82 of the supporting members 28. Also, auxiliary screws 60 are used to more effectively ensure the fixture of the supporting members 28 with respect to the base members 26. In FIG. 11, the supporting members 28 are altered with supporting members 28' of a substantially rectangular in section. Each of the supporting members 28' is provided on the flat top portion thereof with projecting pawls 86 which are formed by raising a part of the flat top portion so as to serve to securely support face members 48 on the supporting members 28 and 28'.

Figure 12:
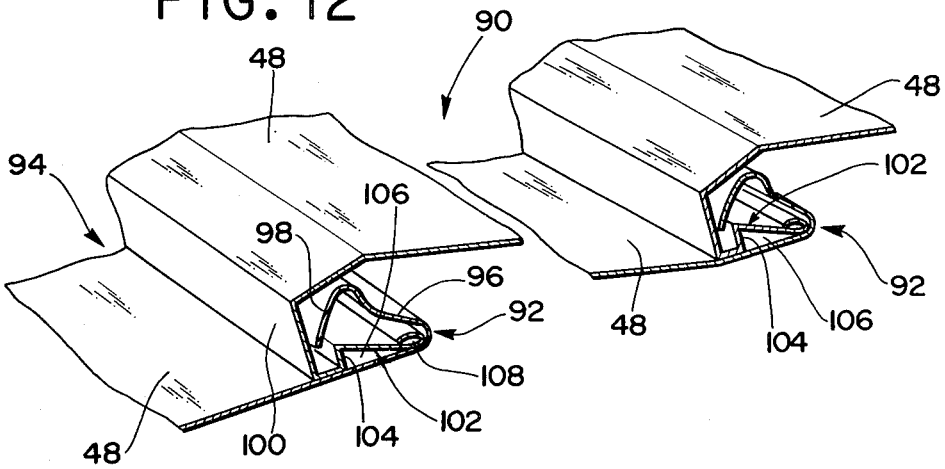
FIG. 12 is an enlarged, partial, perspective view showing connecting portions of face means suitable for use in a wall construction of the present invention.

FIG. 12 illustrates a face means or a roofing means 90 suitable for use in the wall construction of the present invention, which is constructed to weather a violent wind as in a rainstorm. The face means 90 shown in FIG. 12 comprises a plurality of face members 48 laid to overlap one after another in the vertical direction of the wall construction. Each face member 48 has a first turned end area 92 and a second turned end area 94 formed at the upper and lower portions thereof to extend in the lateral direction thereof, respectively, so that the adjacent face members 48 may overlap each other at the turned end areas. The first turned end area 92 inlcudes an obliquely upward extending section 96 and an obliquely downward extending section 98 from the section 96. The second turned area 94 includes a substantially vertically downward extending section 100 and a bottom section 102 extending inward from the section 100 and inserted into the first turned end area 92 of the downward adjacent face member 48. The bottom section 102 of the second turned end area 94 is formed with a rising portion 104 in the lateral direction of the face member 48 so as to be adjacent to the section 98 of the adjacent face member. The bottom section 102 forms a space 106 through the rising portion 104 in cooperation with the downward adjacent face member. The rising portion 104 is adapted to engage with the section 98 of the adjacent face member when the second turned area 94 is raised or lifted by a violent wind, so that the face members 48 may be securely held with respect to each other. The bottom section 102 is also formed with a folded portion 108 at the end thereof to prevent the damage of surface treatment on the first turned end area 92 of the adjacent face member.

The face means or roofing means 90 constructed in such manner as described above has an excellent advantage as compared to a conventional one. More particularly, the conventional face means typically comprises a plurality of face members each having a first turned area formed in the substantially same manner as in the present invention and a second turned area including a substantially vertically downward extending section and a flat bottom section extending inward therefrom and merely inserted into the first turned area of the downward adjacent face member. Therefore, the second turned area is easily separated from the adjacent face member when an external force such as a violent wind is applied to the connecting portion between the adjacent face members, resulting in the face means being easily broken. On the contrary, the face member in the present invention, as described above, is formed at the bottom section 102 of the second turned area 94 with the rising portion 104 which engages with the section 98 of the first turned end area 92 of the adjacent one when an external force is applied to the connecting portion therebetween, so that the face means of the present invention may be securely held.

In addition, the face means of the present invention if formed with the space 106 between the rising portion 104 of the face member and the adjacent one. Thus, the face means has another advantage that the space 106 serves to prevent rainwater from entering through the connecting portion into the interior of the wall construction, because the rainwater is dispersed in the space 106 without producing a capillary action. The space 106 also serves to prevent a wind pressure applied on the lower surface of the bottom section 102 from increasing, to thereby more effectively prevent the lifting of the second turned area 94 due to a violent wind.

The section 96 of the first turned end area may be formed to have at least one valley portion so as to increase the elasticity of the section 96.

FIGS. 13 and 14 illustrate a modification of theface means 90. Each of face members 48 of the face means 90 shown in FIG. 13 also has a first turned end area 92 and a second turned end area 94 formed at the upper and lower portions thereof. The first turned end area 92 is provided with three peaks 112, namely, low outside peaks 114 and 116 and high intermediate peak 118, to allow the strength and elasticity of the turned end area 92 to significantly increase. The second turned end area 94 is formed in a conventional manner to have a substantially vertically downward extending section 100 and a curved bottom section 102 extending inward from the section 100 and inserted into the first turned end section 92 of the downward adjacent face member 48. The first turned end area 92 of the face member is adapted to be fixed with respect to supporting members 28 of the wall construction by fixing members 120 formed of a metal plate. The fixing member 120, as shown in FIG. 15, includes a flat area 122 to be fixed to the supporting member 28 through holes 124 by screws 126 and a fixing area 128. The fixing area 128 includes a section 130 formed in a shape substantially corresponding to the first turned end area 92 so as to grippingly engage with the upper surface of the area 92 and an end section 132 bent in the inward direction to facilitate the engagement with the first turned area 92.

The fixing member 120 may be fixed on the supporting member 28 by welding. In such case, it is not required to provide the flat area 122 with the holes 124. Alternatively, the fixing member may be fixed on the supporting member by means of raised projections formed on the supporting member; and, in this case, the holes 124 are formed in a shape sufficient to insert the projections therethrough. In addition, the connecting portion of the fixing member 120 between the flat area 122 and the fixing area 128 is preferably formed with a reinforcing means 134.

The manner of fixing the face means with respect to the supporting members is now explained with reference to FIGS. 13 and 14.

The face members 48 are fixed in turn on the supporting members in the upward direction. The face means is assembled in such a manner that, into the first turned end area 92 of one face member fixed onto the supporting members 28, the second turned end area 94 of the upward adjacent face member is elastically inserted; then, the fixing members are disposed so that the fixing area 128 fits on the first turned area 92 and the end section 132 grips the end portion 136 of the area 92; and then, the fixing members 120 are securely mounted on the supporting members by fixing the flat area 122 to the supporting members by the screws 126. Alternatively, the first turned area 92 may be clamped by te fixing members after the fixing members are fixed to the supporting members, because the fixing members have elasticity. The face means are assembled by overlapping the face members in turn in such manner as mentioned above.

Thus, the face means are securely fixed on the supporting members with a high strength, because the first turned end area 92 has very high strength and elasticity due to the structure of having the three peaks 112. Such structure allows the second turned end area 94 of the adjacent face member inserted therein to be held with a high strength. This results in the face means havng a strength sufficient to weather a violent wind. In addition, the connecting portion between the adjacent face members is provided with many spaces to effectively prevent rainwater from entering the inside of the face means due to capillary action and the like. Furthermore, the fixing member is formed as an independent single part, with the result that electroplating and machining of the member are easily effected; therefore, it does not adversely affect the contact portion of the upper turned end area with the member. Furthermore, the assembling of the face means may be easily accomplished merely by press-fitting the fixing members on the first turned end area and fixing the flat portions thereof to the supporting members.

Figure 16:
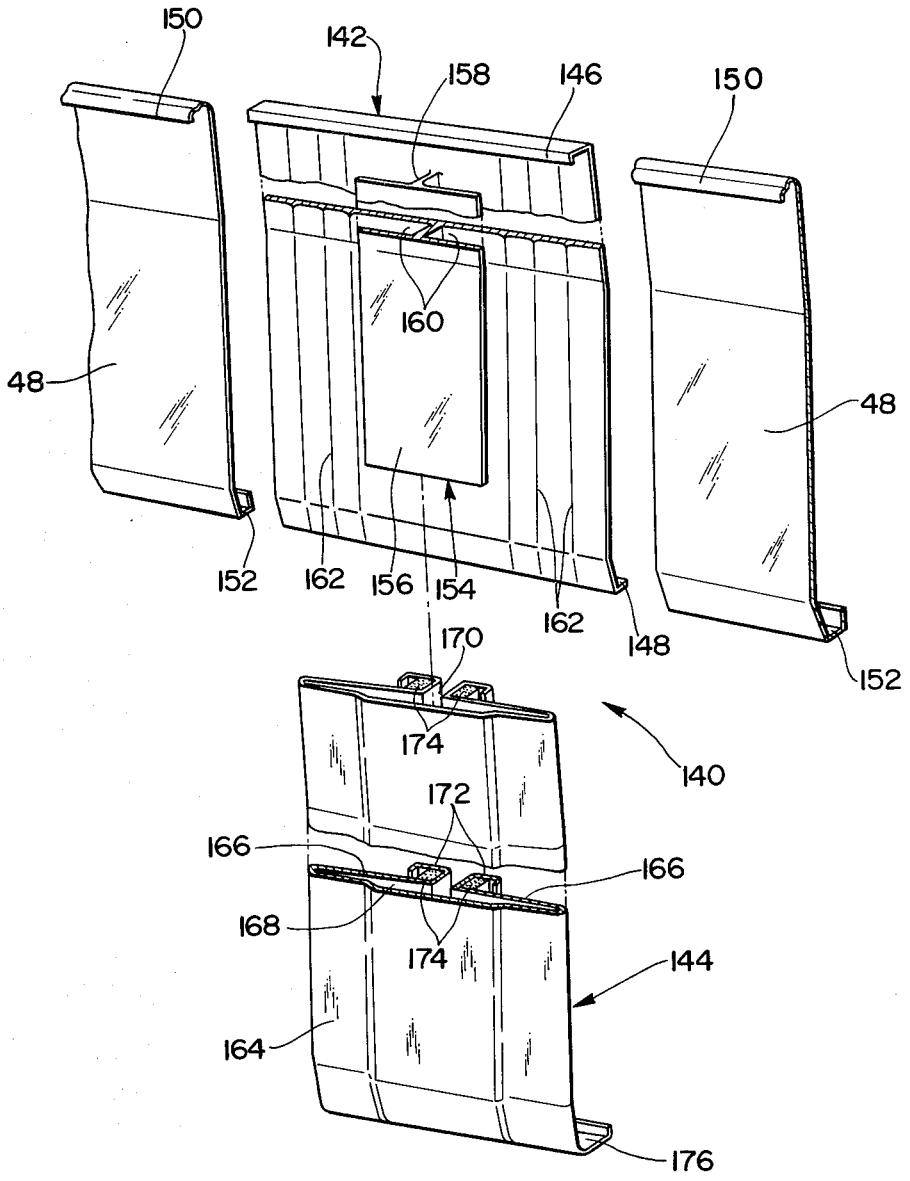
FIG. 16 is an exploded perspective view showing connecting means for connecting laterally adjacent face members to each other.

FIG. 16 illustrates a connecting means suitable for connecting adjacent face members or roofing members disposed in the lateral direction of the wall construction to each other, which is generally designated by reference numeral 140. The connecting means is adapted to effectively prevent arinwater from entering the connecting portion between the adjacent face members, be manufactured at a low cost and be easily assembled in a simple manner.

In the illustrated embodiment, the connecting means 140 is adapted to be used for an outer wall construction. The connecting means 140 comprises a connecting member 142 and a holding member 144. The connecting member 142 may be formed, for example, by extrusion of a metal such as aluminum or the like. The connecting member 142 is provided at the upper end thereof with a fitting portion 146 turned outward and at the lower end thereof with a fitting portion 148 turned inward. The upper fitting portion 146 receives therein a part of the upper engaging portions 150 of adjacent face members 48, and the lower fitting portion 148 receives thereon a part of the lower engaging portions 152 of the members 48. The connecting member 142 is also provided at the central portion of the front surface thereof with a supporting plate 154 of a substantially T shape in section. The supporting plate 154 is formed integrally with the connecting member 142 and has a flat portion 156 substantially parallel to the connecting member and a leg portion 158 through which the flat portion 156 is connected to the connecting member 142, so that two spaces 160 are defined on the both sides of the leg portion 158 between the flat portion 156 and the connecting member 142. The connecting member 142 is provided on the front surface thereof with a plurality of projections 162 which extend in the vertical direction spaced from one another at a suitable interval. The projections 162 act to guide the face members when those are inserted into the connecting means in such manner as mentioned hereinafter. Also, the projections, if rainwater enters the connecting means, prevent it from diffusing within the connecting means.

The connecting member 142 can be manufactured in the following manner. First, an integrally molded article in continuous length having a supporting plate 154 and projections 162 is formed of aluminum. Then, the molded article is cut into connecting members 142 of a predetermined length. Finally, each of the connecting members 142 is formed with fitting portions 146 and 148 by bending. Thus, it will be noted that the connecting member can be manufactured with ease and at a low cost.

The holding member 144 of the connecting means 140 serves to be fitted on the supporting plate 154 to securely hold the laterally adjacent face members 48 with respect to the connecting member 142. The holding member 144 may be formed of a single metal sheet to have a front wall 164 and a pair of rear walls 166, with a space 168 being defined therebetween sufficient to receive the flat portion 156 of the supporting plate 154 therein. The rear walls 166 have a space 170 defined therebetween in which the leg portion 158 of the supporting plate 154 is received. The holding member 144 is further provided at the outside of the rear walls 166 with portions 172 of a substantially rectangular shape in section for receiving the ends opposite to each other of the adjacent face members 48 therein. The receiving portions 172 are formed by outward bending the ends of the metal sheet in the direction opposite to each other. The ends of the metal sheet terminate a little away from the rear walls to define gaps therebetween sufficient to insert the ends of the adjacent face members therethrough, respectively. Each end of the metal sheet is preferably turned inwardly to prevent rainwater from entering the receiving portion 172 and more effectively support the face members 48 with respect to the connecting means 140. Each of the receiving portions 172 has an elastic calking material 174 received therein adjacent to the space 170 which extends in the longitudinal direction thereof.

The holding member 144 is provided at the lower end thereof with a fitting portion 176 for receiving a part of the lower engaging portion 152 of each face member 48 therein. In addition, the holding member 144 may be provided at the upper end thereof with a fitting portion on which a part of the upper enganing portion 150 of the face member is fitted.

The manner of use of the connecting means 140 will be explained hereinafter with reference to FIGS. 16 to 18.

First, the holding member 144 is slidably fitted on the supporting plate 154 in the upward direction to receive the flat portion 156 and leg porion 158 of the supporting plate in the spaces 168 and 170, respectively. However, at this stage, the fitting of the holding member 144 on the plate 154 is preferably left unfinished. Then, the adjacent face members 48 are slided along the projections 162 of the front surface of the connecting member 142 to allow a part of the upper engaging portions 150 of the member 48 to be fitted in the upper fitting portion 146 of the connecting member 142 and allow a part of the lower engaging portions 152 to be fitted on the lower fitting portion 148. The face members are further forced, resulting in the ends of the members 48 being inserted in the receiving portions 172 to abut against the calking materials 174. Then, the holding member 144 is pushed up to engage the lower fitting portion 176 of the member 144 with a part of the lower engaging portions 152 of the face members 48 and allow the upper end of the member 144 to abut against the upper fitting portion 146 of the connecting member 142.

The connecting means 140, as apparent from the foregoing, is constructed in the manner that the holding member 144 is supported by the fitting portions 146 and 148 of the connecting member 142 and the engaging portions 152 and 150 of the face members 48. Therefore, it will be noted that the holding member is effectively supported by the connecting member and the face members without being provided with the supporting plate 154. Such modification of the connecting member is illustrated in FIG. 19.

Figure 17:
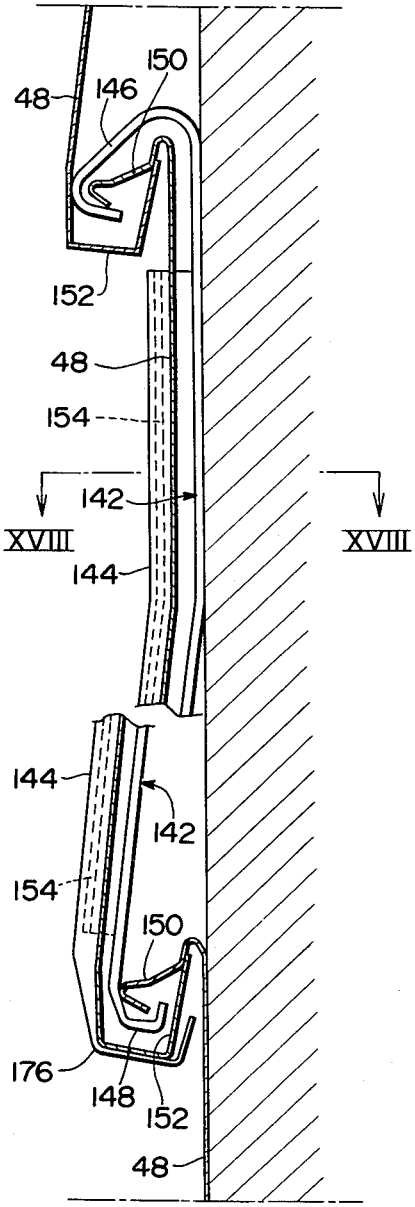
FIG. 17 is a partially cutaway, longitudinal sectional view of the connecting means shown in FIG. 16.
Figure 18:
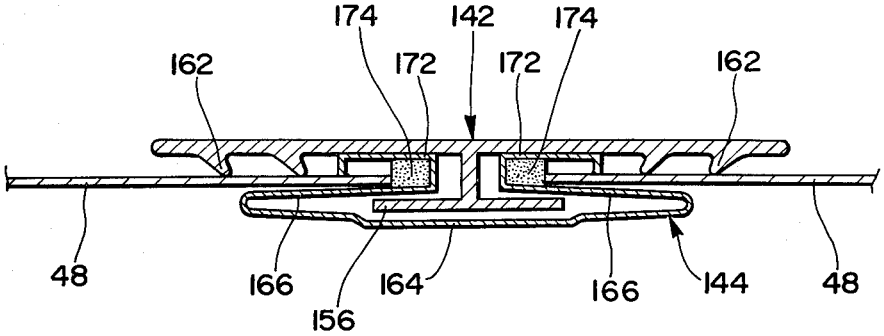
FIG. 18 is a sectional view taken along the line XVIII—XVIII of FIG. 17.
Figure 19:
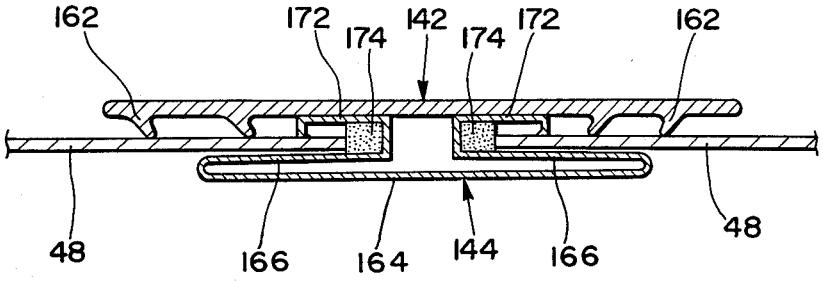
FIG. 19 is a sectional view showing a modification of the connecting means shown in FIG. 17.

The connecting means 140 of FIG. 19 is constructed in the substantially same manner as that of FIGS. 16 to 18, except that a supporting plate is not provided. More particularly, it is constructed so that the end portions of adjacent face members 48 may be securely abutted against calking materials 174 and receiving portions 172 of a holding member 144 are substantially closed. Therefore, the face members are securely and stably supported by the connecting means 140 and rainwater is effectively prevented from entering the receiving portions. In addition, the receiving portions are constructed to have an elasticity, therefore, the deformation of the face members due to variation in atmospheric temperature is effectively absorbed by the receiving portions and the calking materials.

It will thus be seen that the objects set forth above, among those made apparent in the preceding description, are efficiently attained and, since certain changes may be made in the above constructions without departing from the spirit and scope of the invention, it is intended that all matter contained in the above description or shown in the accomanying drawings shall be interpreted as illustrative and not in a limiting sense.

It is also to be understood that the following claims are intended to cover all of the generic and specific features of the invention herein described, and all statements of the scope of the invention, which, is a matter of language, might be said to fall therebetween.

I claim:

1. A wall construction for an architectural structure comprising:

base means;

first coat means laid on said base means;

a plurality of elongated supporting members each formed of metal sheet by bending and disposed on said first coat means in the vertical direction of said wall construction so as to be spaced from each other at a predetermined interval in the lateral direction of said wall construction;

a plurality of sheathing members each fixedly supported at both ends thereof on said adjacent supporting members to cover said first cost means and define a space between said sheathing members and said first coat means, and face means laid on said sheathing members, said face means including a plurality of face members disposed adjacent to one another in the lateral direction of said wall construction, said laterally adjacent face members being connected to each other by connecting means, said face members including engaging portions at the upper and lower ends thereof, said connecting means comprising a connecting member provided at the upper and lower ends thereof with engaging portions respectively fitted with respect to said upper and lower engaging portions of said laterally adjacent face members, and a holding member for holding said adjacent face members with respect to said connecting member;

said holding member having a front wall and a rear wall separated into two sections with a gap interposed therebetween and being formed at the upper and lower ends thereof with engaging portions respectively fitted with respect to said upper and lower engaging portions of said adjacent face members;

ends adjacent to each other of said sections of said rear wall being formed at the outside portion thereof with receiving means which respectively receive therein ends opposite to each other of said adjacent face members; and said receiving means being filled at the portions thereof adjacent to each other with a calking material

2. A wall construction as defined in claim 1, wherein said holding member is the product of integrally forming metal sheet by bending.

3. A wall construction as defined in claim 1, wherein said connecting member has a supporting member integrally attached to the front surface thereof, said supporting member including a flat portion substantially parallel to said connecting member and a leg portion through which said flat portion is conneced to said connecting member;

said holding member being formed with a space between said fron wall and said rear wall, said flat portion and leg portion being respectively receivable in said space and said gap between said sections of said rear wall.

4. A wall construction as claimed in claim 1, wherein said receiving means are of a substantially rectangular shape in section.

5. A connecting structure for a wall construction of an architectural structure which serves to connect laterally adjacent face members to each other comprising:

a connecting member provided at the upper and lower ends thereof with engaging portions respectively fitted with respect to upper and lower engaging portions of the adjacent face members;

a holding member for holding the adjacent face members with respect to said connecting member, said holding member being integrally formed of a metal sheet to have a front wall, a rear wall separated into two sections with a gap interposed therebetween, and receiving means respectively formed at the outside portions of ends adjacent to each other of said sections of said rear wall which respectively receive therein ends opposite to each other of the adjacent face members;

said receiving means being filled at the portions thereof opposite to each other with a calking material.

6. A connecting structure as deined in claim 5, wherein said connecting member has a supporting plate integrally attached to the front surface thereof, said supporting member including a flat portion substantially parallel to said connecting member and a leg portion through which said flat portion is connectd to said connecting member;

said holding member being formed with a space between said front wall and said rear wall, said flat portion and leg portion being respectively receivable in said space and said gap.

7. A connecting structure as claimed in claim 1, wherein said receiving means are of a substantially rectangular shape in section.

* * * * *